US005606760A

United States Patent [19]

De Guzman

[11] Patent Number: 5,606,760

[45] Date of Patent: Mar. 4, 1997

[54] SELF-WRINGING MOP AND WRINGER ASSEMBLY, CLEANING ELEMENT ASSEMBLY AND CLEANING ELEMENT FOR USE WITH SAME

[75] Inventor: Joselito De Guzman, Redondo Beach, Calif.

[73] Assignee: Micronova Manufacturing, Inc., Torrance, Calif.

[21] Appl. No.: 486,914

[22] Filed: Jun. 7, 1995

[51] Int. Cl.[6] ..... A47L 13/12

[52] U.S. Cl. ..... 15/119.2; 15/209.1; 15/228; 15/244.4

[58] Field of Search ..... 15/119.2, 49.1, 15/119.1, 207.1, 228, 244.1, 244.2, 244.4

[56] References Cited

U.S. PATENT DOCUMENTS

| | | | |
|---|---|---|---|
| 2,176,908 | 10/1939 | Korner et al. | 15/119.2 |
| 2,572,978 | 10/1951 | Bogan | 15/119.2 |
| 2,866,991 | 1/1959 | Chao | 15/244.1 |
| 2,977,625 | 4/1961 | Hopkins | 15/244.1 |
| 3,037,229 | 6/1962 | Anderson | 15/244.1 |
| 3,076,216 | 2/1963 | Anderson | 15/244.1 |
| 3,220,040 | 11/1965 | Knaebe | 15/244.1 |
| 3,233,269 | 2/1966 | Scheffold | 15/119.2 |
| 4,464,807 | 8/1984 | Weiss | 15/119.2 |
| 4,571,766 | 2/1986 | Goldman et al. | 15/244.1 |
| 4,908,901 | 3/1990 | Torres . | |
| 5,067,197 | 11/1991 | Cormier | 15/244.1 |

*Primary Examiner*—David Scherbel
*Assistant Examiner*—James F. Hook
*Attorney, Agent, or Firm*—Poms, Smith, Lande & Rose Professional Corporation

[57] ABSTRACT

A self-wringing mop includes a powered actuator device operably connected to a cleaning element assembly for moving the cleaning element assembly from a use position to a wringing position. A cleaning element, which may be used with a self-wringing mop, includes a main body defining a top surface, a bottom surface and at least one aperture associated with the main body and passing completely through the main body from the top surface to the bottom surface. A bracket, which may be used with the cleaning element, includes a holding member and at least one bracket attachment member extending through the at least one aperture and adapted to be secured to a mop's cleaning element assembly attachment member. A wringer head assembly, which may be used with the self-wringing mop, includes a mounting rod, a roller mounted on the mid-portion of the mounting rod, and an end cap mounted on each of the ends of the mounting rod. A torsion control device may also be included on the wringer head assembly, as may a base adapted to be inserted into a hollow mop handle.

18 Claims, 9 Drawing Sheets

FIG. 1
PRIOR ART
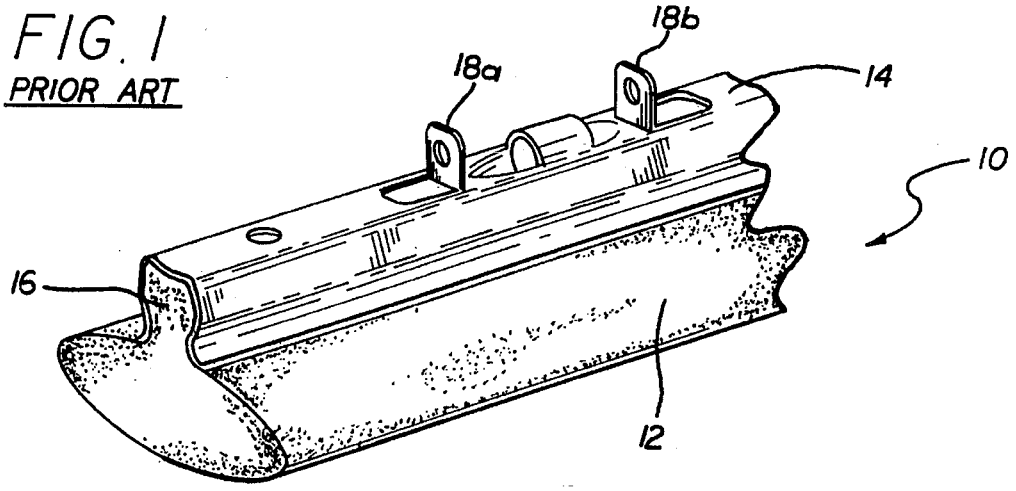
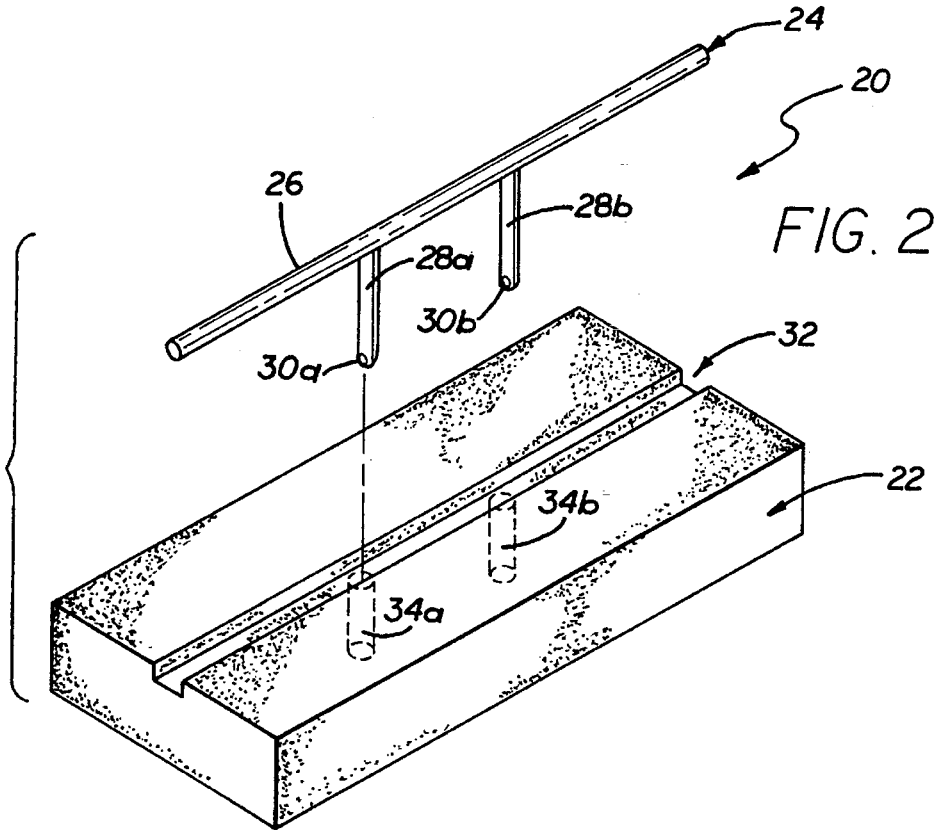
FIG. 2

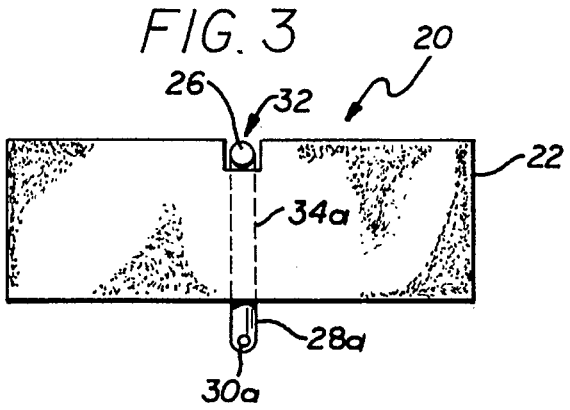
FIG. 3
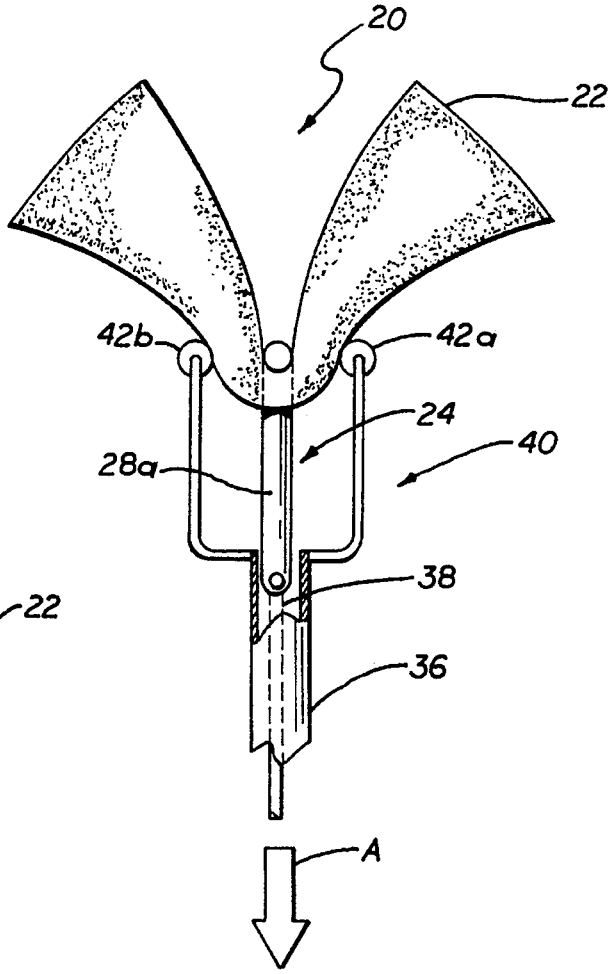
FIG. 4
FIG. 6
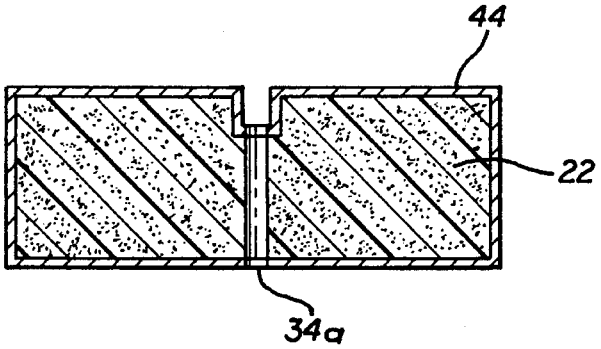

FIG. 13
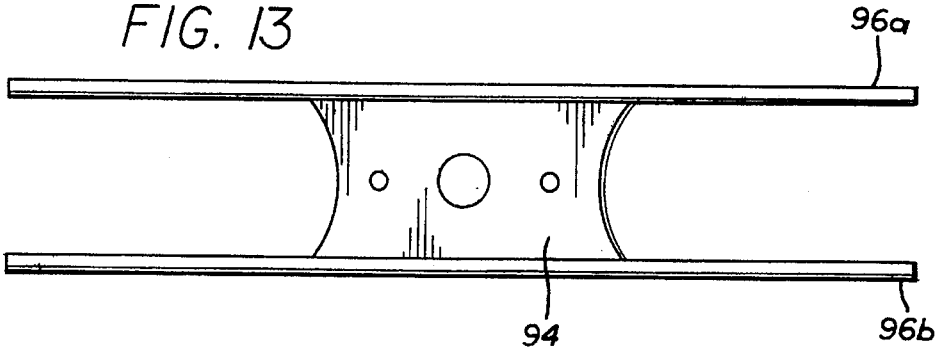
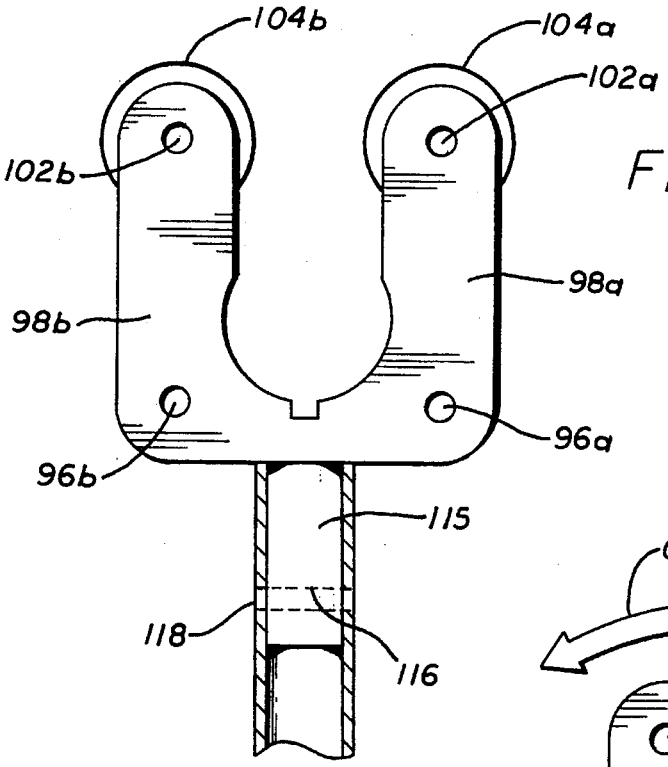
FIG. 14
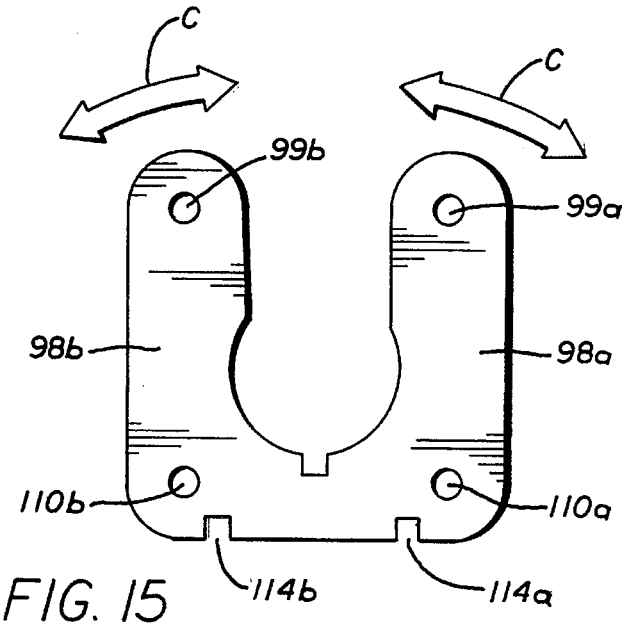
FIG. 15

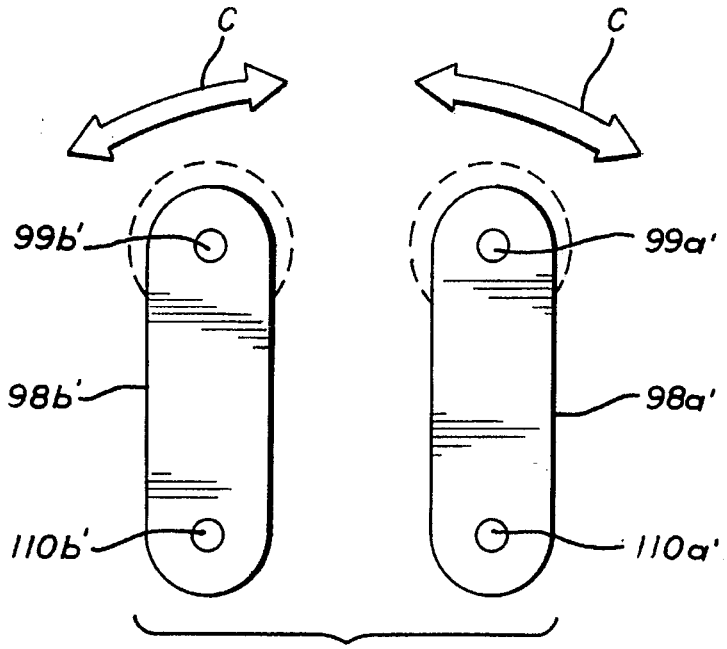
FIG. 16
FIG. 17
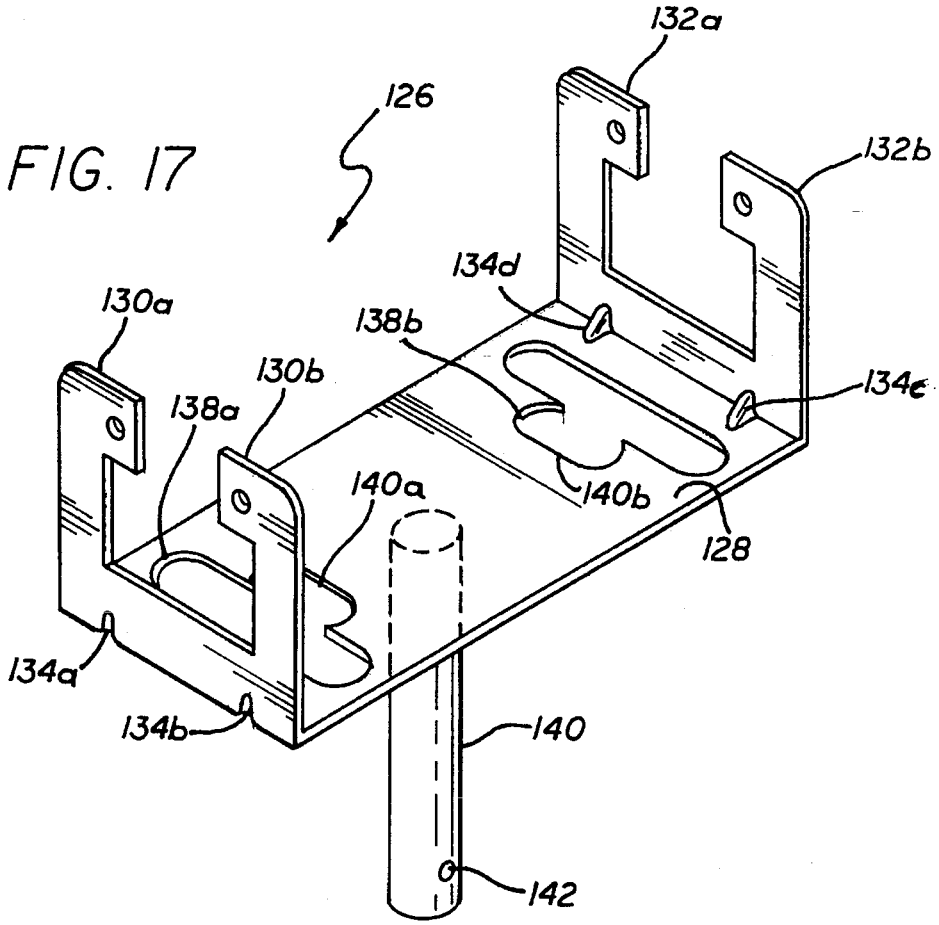

SELF-WRINGING MOP AND WRINGER ASSEMBLY, CLEANING ELEMENT ASSEMBLY AND CLEANING ELEMENT FOR USE WITH SAME

BACKGROUND OF THE INVENTION

1. Field of Invention

The present invention relates generally to self-wringing mops and, more particularly, to self-wringing mops that can accept a replacement cleaning element assembly and to such replacement cleaning elements and mop head assemblies.

2. Description of the Related Art

Self-wringing mops, which include a replaceable sponge assembly that is movable between a cleaning, or use, position and a wringing position, are well known. The sponge assembly is typically connected to an actuator rod, which is itself connected to a lever that is manually operated by the person using the mop. When the user moves the lever away from the sponge assembly, the rod pulls the sponge assembly through a pair of rollers held by a wringer head assembly. The rollers apply pressure to the sponge to wring liquid from the sponge. The lever may then be moved in the opposite direction to return the sponge assembly to the cleaning position. One example of a conventional self-wringing sponge mop is the so-called roll-o-matic sponge mop.

The sponge assemblies employed in self-wringing sponge mops are typically composed of a sponge held by a metal clamp adapted to be connected to the actuator rod. The metal clamp holds the sponge in place and serves as an adapter which allows the sponge assembly to be connected to the mop. One example of a sponge assembly is illustrated in U.S. Pat. No. 4,908,901, which issued in 1990 to Torres.

There are a number of disadvantages associated with conventional self-wringing sponge mops in general, and with conventional sponges, sponge assemblies, and wringer head assemblies in particular.

Turning first to the sponge assemblies, many of the disadvantages associated with conventional sponge assemblies derive from the metal clamp which holds the sponge. The clamp covers and holds a significant portion of the sponge. The covered and clamped portion of the sponge is not affected by the squeezing force applied by the rollers. As such, bacteria, dirt and other contaminants can become trapped within this portion of the sponge, as can moisture, which leads to the growth of mildew. The clamps also include sharp edges which can scratch persons using the mop, the surfaces being mopped and items on or adjacent to these surfaces and possibly produce other contaminants such as particulates. Other shortcomings of conventional sponge assemblies relate to the fact that the clamp is permanently affixed to the sponge and is discarded with the sponge when the sponge is worn out. Not only is it wasteful to throw away a clamp which is not itself worn out, but the clamp cannot be compressed and adds significant weight and volume to the material which is to be disposed of. Thus, disposal of conventional sponge assemblies can be especially expensive in situations where the sponge mop is being used in conjunction with hazardous substances that cannot be disposed of by conventional techniques. Finally, as the clamp must be manufactured and attached to the sponge, it adds a significant amount to the cost of the sponge assembly.

Another disadvantage associated with conventional sponge assemblies is related to covers which are sometimes used to cover the sponge. Covers are often composed of material such as polyvinyl alcohol (PVA) and provide a relatively non-linting, smooth and absorbent cleaning surface. However, due to the manner in which sponges are attached to conventional clamps, the cover separates from the sponge as the sponge passes through the rollers. This prevents the rollers from wringing liquid, dirt and other contaminants from the cover.

The shape of the sponge used in conventional sponge assemblies can also be improved. For example, the portion of the sponge's total surface area that is actually available for scrubbing or wiping is limited. In addition, the side portions of the sponge tend to be narrow and not well adapted for scrubbing. As such, conventional sponge assemblies do not make efficient use of the sponge's potentially available scrubbing surface and cannot be as easily used to clean walls and other vertically extending surfaces as desired.

With respect to the self-wringing sponge mops themselves, a significant amount of force must be applied to the lever in order to pull the sponge through the rollers and wring liquid from the sponge. A similar amount of force must be applied to return the sponge to the use position. Accordingly, use of conventional self-wringing sponge mops over prolonged periods can be quite fatiguing. Moreover, the amount of force required to operate the lever is often greater than that which can be generated by persons of somewhat limited physical capabilities, such as those afflicted with disabilities.

The wringer head assembly of conventional self-wringing sponge mops can also be troublesome. For example, the ends of the roller mounting rods often become exposed and can scratch persons using the mop, the surfaces being mopped, and items on or adjacent to these surfaces. In addition, bacteria, dirt and other contaminants often enter the mop's tubular handle at the point of connection between the handle and the wringer head assembly. Such contaminants can escape during subsequent uses of the mop. Conventional wringer head assemblies also tend to be formed from two pressed pieces of sheet metal. Each piece supports a single roller. Such an arrangement makes it particularly difficult to control the amount of assembly flexing during wringing processes. In addition, such assemblies are riveted to the mop handle, thereby reducing the flexibility of the mop and making it difficult to replace a damaged assembly. The configuration of conventional wringer head assemblies also makes it difficult to replace the sponge assembly.

Accordingly, a need exists for a sponge assembly having both an improved sponge holding apparatus and a more efficient sponge design. A need also exists for a self-wringing sponge mop which does not require the person using the mop to manually apply a significant amount of force to drive the sponge from the use position, through the rollers, and then back again. There is also a need for a roller assembly which is less likely to cause scratching and allow contaminants into the mop's handle, and which is capable of controlled flexing and easy replacement.

OBJECTS AND SUMMARY OF THE INVENTION

A general object of the present invention is to provide an improved self-wringing mop which reduces or obviates, for practical purposes, the aforementioned problems in the art. In particular, one object of the present invention is to provide an improved wipe, cleaner, sponge or other cleaning element assembly which eliminates the cleanliness, safety, wastefulness and waste disposal problems associated with conventional sponge assemblies.

Another object of the present invention is to provide an improved cleaning element which has a larger portion of its surface area available for scrubbing and which is adapted for use on vertically extending surfaces.

A further object of the present invention is to provide an improved self-wringing mop which is itself capable of pulling the cleaning element through the rollers and returning it to the use position without the application of a significant amount of force by the user.

An additional object of the present invention is to provide an improved wringer head assembly which is adapted to prevent bacteria, dirt and other contaminants from entering the mop's handle at the connection point between the handle and the wringer head assembly and which is less likely to cause scratching. A related object is to provide a wringer head assembly which will flex in a controlled manner and which can be easily replaced. A further object is to provide a wringer head assembly which is less likely to interfere with the removal and replacement of cleaning elements.

In order to accomplish some of these objectives, one embodiment of a cleaning element in accordance with the present invention includes a main body defining a top surface and a bottom surface, and at least one aperture associated with the main body and passing completely through the main body from the top surface to the bottom surface. A preferred embodiment of a cleaning element assembly in accordance with the present invention includes the cleaning element described above in combination with a bracket including a holding member and at least one bracket attachment member. The bracket attachment member extends from the holding member through the at least one aperture and is adapted to be secured to a corresponding attachment member on the mop.

There are a number of advantages associated with the present cleaning element and cleaning element assembly. For example, the present bracket does not cover and hold a significant portion of the cleaning element. Thus, the present bracket does not prevent bacteria, dirt, moisture and other contaminants from being wrung from large portions of the cleaning element, as do conventional clamps. The present bracket also lacks the sharp edges associated with conventional clamps and, therefore, does not tend to scratch surfaces which come into contact with the cleaning element assembly. Another advantage of the present cleaning element assembly is that the bracket does not have to be permanently attached to the cleaning element, as do conventional clamps. Only the cleaning element need be replaced when it is worn. Accordingly, the waste and manufacturing costs associated with providing a new clamp with every new cleaning element are eliminated. So are the disposal problems associated with having to dispose of a clamp with every worn cleaning element. Another benefit of not permanently attaching the cleaning element to the device used to secure the cleaning element to the mop is that the cleaning element may be configured in such a manner that when one side of the cleaning element is worn, the cleaning element may be separated from the bracket and turned over for continued use. Such a cleaning element would last approximately twice as long as a similar cleaning element employed in a conventional sponge assembly.

When a cover is used to cover the cleaning element in the present cleaning element assembly, the holding member will prevent the cover from separating from the cleaning element. Thus, liquid, dirt and other contaminants will be more effectively wrung from the cover than they would if conventional cleaning element assemblies were used.

The present cleaning elements themselves may be provided in a number of shapes. Such flexibility allows the cleaning elements to be specifically designed for particular tasks. For example, the sides of the cleaning element may be somewhat wide so as to facilitate the cleaning of vertically extending surfaces.

In order to accomplish other objectives, one embodiment of a self-wringing mop in accordance with present invention includes an actuator device, operably connected to a cleaning element assembly, for moving the cleaning element assembly from the use position to the wringing position. The actuator device reduces the need for the user to apply a significant amount of force to a lever in order to move the cleaning element assembly into the wringing position and then back to the use position. Therefore, the present self-wringing mop is less fatiguing than conventional self-wringing mops and may be more easily used by persons of limited physical capabilities.

Finally, in order to accomplish still other objectives, a wringer head assembly in accordance with the present invention includes a mounting rod, a roller mounted on the mid-portion of the mounting rod, and an end cap mounted on each of the ends of the mounting rod. The end caps prevent the scratching associated with the conventional wringer head assemblies. In addition, the end caps may be configured such that they function as additional portions of the rollers. A torsion control device may also be included, as may a base adapted to be inserted into a hollow mop handle. The torsion control device allows the wringer head assembly to flex in a controlled manner and the base allows the wringer head assembly to be easily replaced and prevents liquid from entering the handle. The wringer head assembly may also configured such that the members that support the mounting rods will not interfere with the removal and replacement of the cleaning elements.

The above described and many other features and attendant advantages of the present invention will become apparent as the invention becomes better understood by reference to the following detailed description when considered in conjunction with the accompanying drawings.

BRIEF DESCRIPTION OF THE DRAWINGS

Detailed description of preferred embodiments of the invention will be made with reference to the accompanying drawings.

FIG. 1 is a perspective view of a conventional sponge assembly.

FIG. 2 is an exploded perspective view of a cleaning element assembly in accordance with one aspect of the present invention.

FIG. 3 is an assembled side view of the cleaning element assembly shown in FIG. 2.

FIG. 4 is a side view showing the cleaning element assembly shown in FIG. 3 being used in conjunction with a self-wringing mop.

FIG. 6 is a section view of the cleaning element shown in FIG. 2 which includes a cover.

FIG. 13 is a top view of a portion of the wringer head assembly shown in FIG. 12.

FIG. 14 is a side view of the wringer head assembly shown in FIG. 12.

FIG. 15 is a plan view of a pair of roller axis support members which may be used in conjunction with the wringer head assembly shown in FIG. 12 combined to form a unitary structure.

FIG. 16 is a plan view of a pair of roller axis support members which may be used in conjunction with the wringer head assembly shown in FIG. 12.

FIG. 17 is a perspective view of another embodiment of a wringer head assembly in accordance with the present invention.

DETAILED DESCRIPTION OF THE PREFERRED EMBODIMENTS

Figure 5:
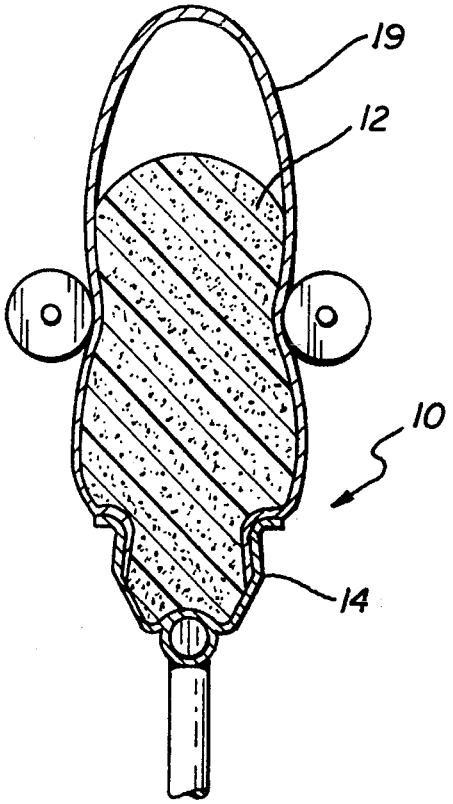
FIG. 5 PRIOR ART
FIG. 5 is a section view of a conventional sponge assembly which includes a sponge cover being used in conjunction with a self-wringing mop.

The following is a detailed description of a number of preferred embodiments of the present invention. This description is not to be taken in a limiting sense, but is made merely for the purpose of illustrating the general principles of the invention. The scope of the invention is defined by the appended claims.

As illustrated in FIG. 1, conventional self-wringing sponge mop assemblies, such as that generally indicated by reference numeral 10, include a sponge 12 which is held by a clamping member 14. Clamping member 14 is permanently secured to sponge 12 and occupies a significant portion 16 of the sponge. This portion will not be compressed when the sponge assembly is pulled through a wringer. As such, contaminants such as dirt and bacteria can be trapped in this portion of the sponge. Also, because the clamp is permanently secured to the sponge, it must be discarded with the sponge when the sponge is worn, which is costly and inefficient. Clamping member 14 includes a pair of tabs 18*a* and 18*b* having apertures formed therein. The apertures are used to connect clamping member 14 to a pair of resilient connectors associated with the self-wringing mop's actuator rod.

Turning to the one of the preferred embodiments, which is illustrated in FIGS. 2 and 3, a cleaning element assembly in accordance with the present invention (generally indicated by reference numeral 20) includes a cleaning element 22 and a bracket 24. The preferred bracket includes a horizontally extending portion 26 and at least one but preferably a pair of bracket members 28*a* and 28*b*. The illustrated bracket members include a pair of apertures 30*a* and 30*b* which may be used to connect the bracket to a pair of resilient connectors associated with a self-wringing mop's actuator rod. A plurality of longitudinally spaced apertures (not shown) may also be provided on each bracket member so that the bracket may be used with cleaning elements having a variety of thickness.

The present construction secures the cleaning element without preventing a significant portion of the cleaning element from being wrung. As a result, dirt, moisture and other contaminants will be more effectively wrung from the present cleaning element then they will from conventional clamp and sponge assemblies. In addition, the bracket does not have to be permanently attached to the cleaning element. Thus, it does not have to be discarded when the cleaning element needs be replaced. Finally, there need not be any sharp edges associated with the present bracket, thereby substantially reducing the scratching and the potential production of particulates associated with the conventional arrangements.

When the cleaning element assembly is in the assembled state shown in FIG. 3, horizontally extending portion 26 of the bracket rests in a channel 32 formed on the surface of cleaning element 22 and bracket members 28*a* and 28*b* extend through a pair of apertures 34*a* and 34*b*, respectively. The channel may be rectangular, as shown in FIGS. 2 and 3, or may be rounded, triangular or other shapes. In addition, the channel may be formed on both sides of the cleaning element. Thus, when one side of the cleaning element is spent, the cleaning element may be turned over for continued use. The shape of the bracket members and the horizontally extending portion may also be varied.

In accordance with the preferred embodiment, the bracket may be formed from electro-polished stainless steel. However, other materials, such as aluminum, steel or plastic, may be used. Turning to the dimensions of the preferred bracket, it is approximately 14 inches long and ⅜" in diameter. Clearly, the present invention is not limited to the exemplary materials and dimensions may be adapted as needed for specific applications.

The overall configuration of cleaning element assembly 20 is not limited to the preferred embodiment shown in FIGS. 2 and 3. Rather, the configuration may be varied in order to adapt the cleaning element assembly to a variety of self-wringing cleaning element mops. For example, the end of the actuator rod in certain types of self-wringing mops is threaded. In this case, bracket 24 could be provided with a single bracket member having a threaded receptacle adapted to receive the threaded end of the rod. The cleaning element used with such a bracket would be provided with a single aperture extending therethrough. The single bracket member could also be eliminated and a threaded receptacle could be provided on the longitudinally extending portion of the bracket. Here, the threaded rod would extend through the cleaning element to the receptacle. The end of the actuator arm in another type of self-wringing mop is L-shaped and includes a small end portion extending at a right angle therefrom. Here, the longitudinally extending portion of the bracket would be fitted with a tunnel adapted to receive the small, right angle end portion of the rod and the aperture in the cleaning element could shaped and sized accordingly.

Figure 10:
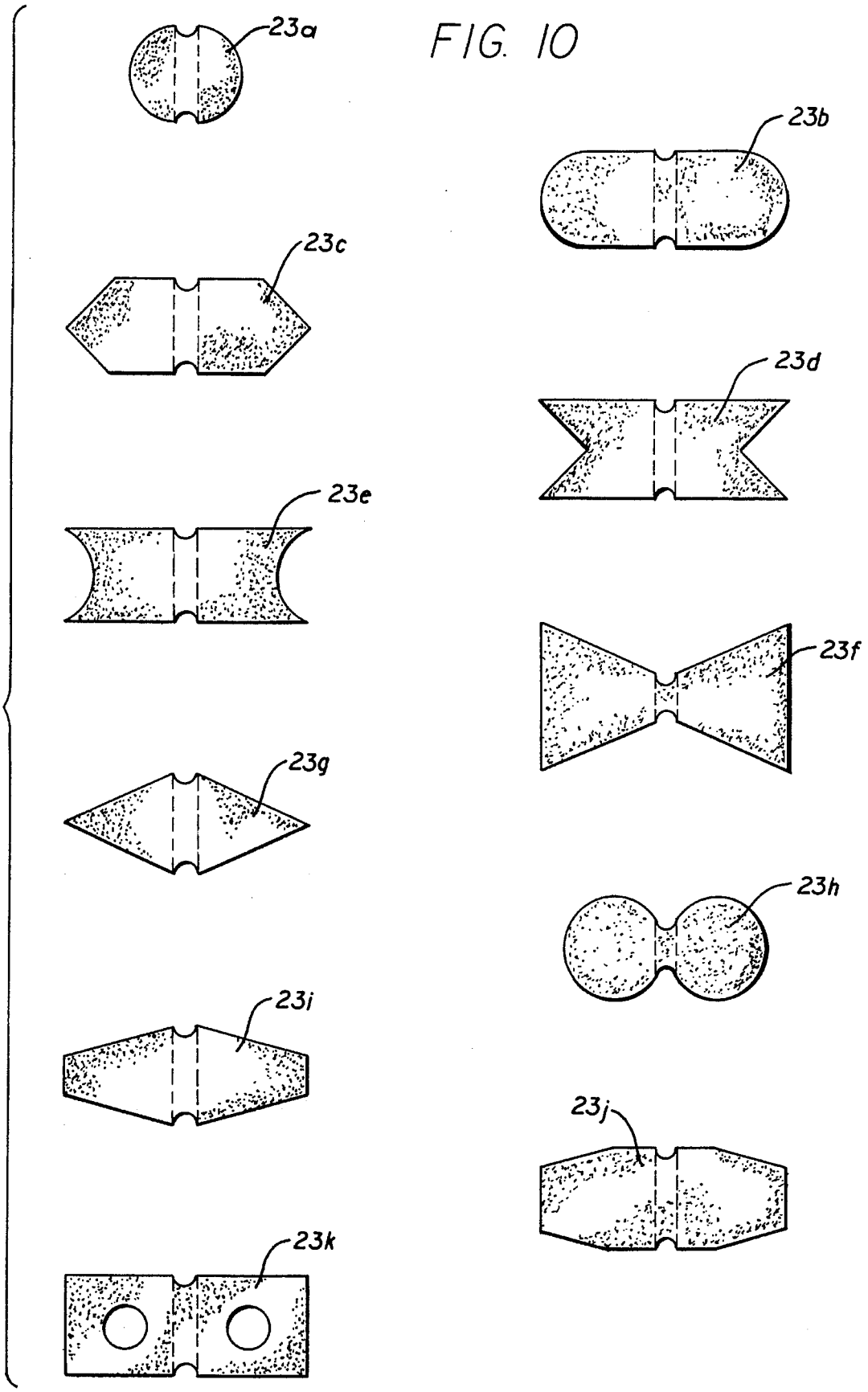
FIG. 10 is a plurality of section views of cleaning elements having a variety cross-sectional shapes.

The configuration of the cleaning element itself is not limited to a cleaning element with a generally rectangular cross-section, such as that shown in FIGS. 2 and 3. Rather, the shape of the cross-section may be varied in accordance with the intended use of the cleaning element. As illustrated for example in FIG. 10, the cross-section of the cleaning element may be round (cleaning element 23*a*), generally rectangular with rounded sides (cleaning element 23*b*), generally rectangular with outwardly pointed sides (cleaning element 23*c*), generally rectangular with inwardly pointed sides (cleaning element 23*d*), generally rectangular with concave rounded sides (cleaning element 23*e*), resemble a bow tie (cleaning element 23*f*), resemble two juxtaposed triangles (cleaning element 23*g*), resemble two juxtaposed circles (cleaning element 23*h*), resemble two juxtaposed triangles with squared-off ends (cleaning element 23*i*), generally rectangular with chamfered corners (cleaning element 23*j*), and generally rectangular with holes extending therethrough (cleaning element 23*k*). Additionally, scrubbing pads may be affixed to various portions, or all, of the outer surface of the cleaning element. Finally, the aperture(s) extending through the cleaning element are not limited to a generally round cross-section. Rather, the cross-section of the aperture(s) may be any shape or may be nothing more than a slit which will deform as a bracket member or other device passes therethrough.

The cleaning element may be formed from any suitable cleaning and/or absorbent material. For example, the cleaning element may be composed of a sponge or sponge-like material, or PVA (other examples). It is intended that the term cleaning element encompass all such materials, whether presently known or later developed. Preferably, the cleaning element is composed of polyurethane or PVC coated polyurethane foam.

As shown by way of example in FIG. 4, the present cleaning element assembly 20 may be connected to a self-wringing mop including a handle 36, an actuator rod 38 and a wringer head assembly 40. When the rod moves in the direction indicated by arrow A, bracket 24 is pulled in the same direction and cleaning element 22 is pulled between a pair of rollers 42*a* and 42*b*. The rollers exert pressure on the cleaning element and wring liquid therefrom. Moreover, the cleaning element may be shaped such that it may be used to grasp objects when in the wringing position shown in FIG. 4.

Figure 7:
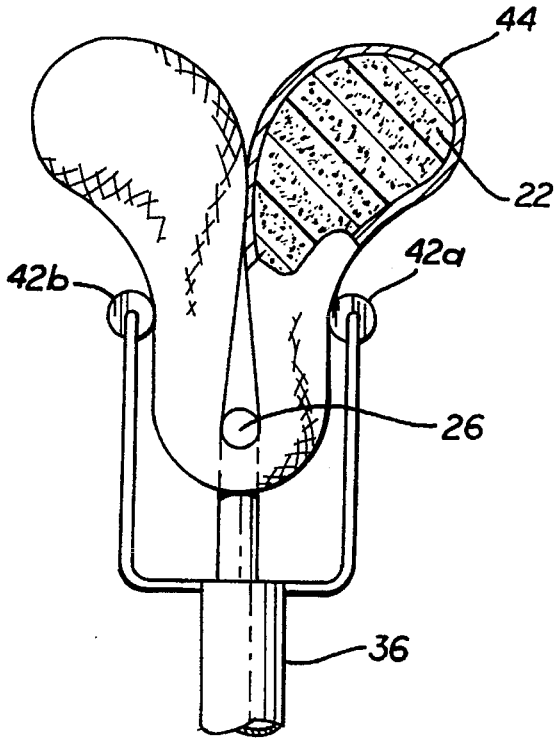
FIG. 7 is a side, partial section view showing the cleaning element assembly shown in FIG. 6 being used in conjunction with a self-wringing mop.

FIG. 5 shows a conventional sponge assembly, such as that illustrated in FIG. 1, with a sponge cover 19 added to the assembly. When the conventional sponge assembly is pulled through the wringer head assembly's rollers, the cover separates from the sponge. Such separation prevents wringing of the cover. Turning to FIGS. 6 and 7, the cleaning element in the present cleaning element assembly may also be fitted with a cover. Specifically, cleaning element 22 may also be provided with a cover 44 composed of PVA, Whitelite™, or other suitable materials known to those skilled in the art. The cover may cover the entire surface of the cleaning element or, alternatively, only a selected portion. When cleaning element assembly 20 is pulled through wringer head assembly rollers 42*a* and 42*b*, the bracket's horizontally extending portion 26 pulls cover 44 against the cleaning element. This advantageously prevents the cover from separating from the cleaning element and insures that the cover will be wrung with the cleaning element. As a result, liquid, dirt and other contaminants will not remain in the cover after wringing, as is often the case with conventional designs.

Figure 8:
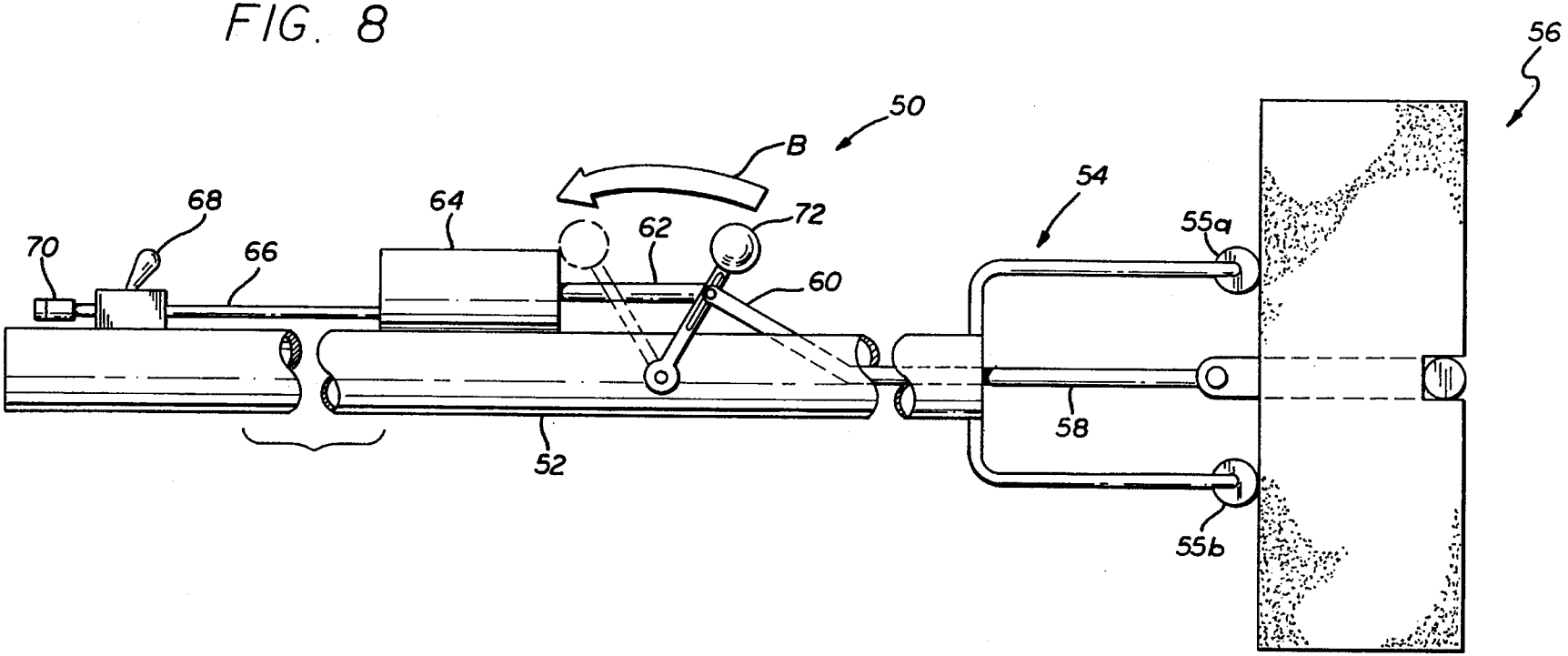
FIG. 8 is a side view of a powered self-wringing mop.

As illustrated for example in FIG. 8, a powered self-wringing mop in accordance with the present invention is generally indicated by reference numeral 50 and includes a handle 52 and a wringer head assembly 54 affixed to one end of the handle. The wringer head assembly includes rollers 55*a* and 55*b*. A cleaning element assembly 56 is operably connected to a rod 58 which extends through handle 52. The illustrated cleaning element assembly is of the type illustrated in FIG. 2. However, the powered self-wringing mop is not limited to use with any particular cleaning element assembly and may be used in conjunction with any cleaning element assembly, including that illustrated in FIG. 1. Rod 58 is connected by a linkage 60 to a pneumatic piston 62 and cylinder 64. The piston is pulled in the direction indicated by arrow B, i.e. into the cylinder, when gas is introduced into the cylinder through line 66. Such movement of piston 62 pulls the cleaning element assembly into the wringing position within the wringer head assembly. As a result, the user of the mop does not have to supply a significant amount of force to a handle in order to wring liquid and dirt from the cleaning element. When the gas is released, an internal spring forces piston 62 out of cylinder 64 and cleaning element assembly 56 is returned to the use position. The flow of gas through line 66 is controlled by a valve 68 that is connected to a source of compressed gas through a "quick-release" type connector 70. The valve is also capable of venting air. The powered self-wringing mop illustrated in FIG. 8 also includes a lever 72 that is connected to linkage 60. The lever may be used to move the mop head assembly to and from the wringing position when compressed gas is unavailable.

Figure 9:
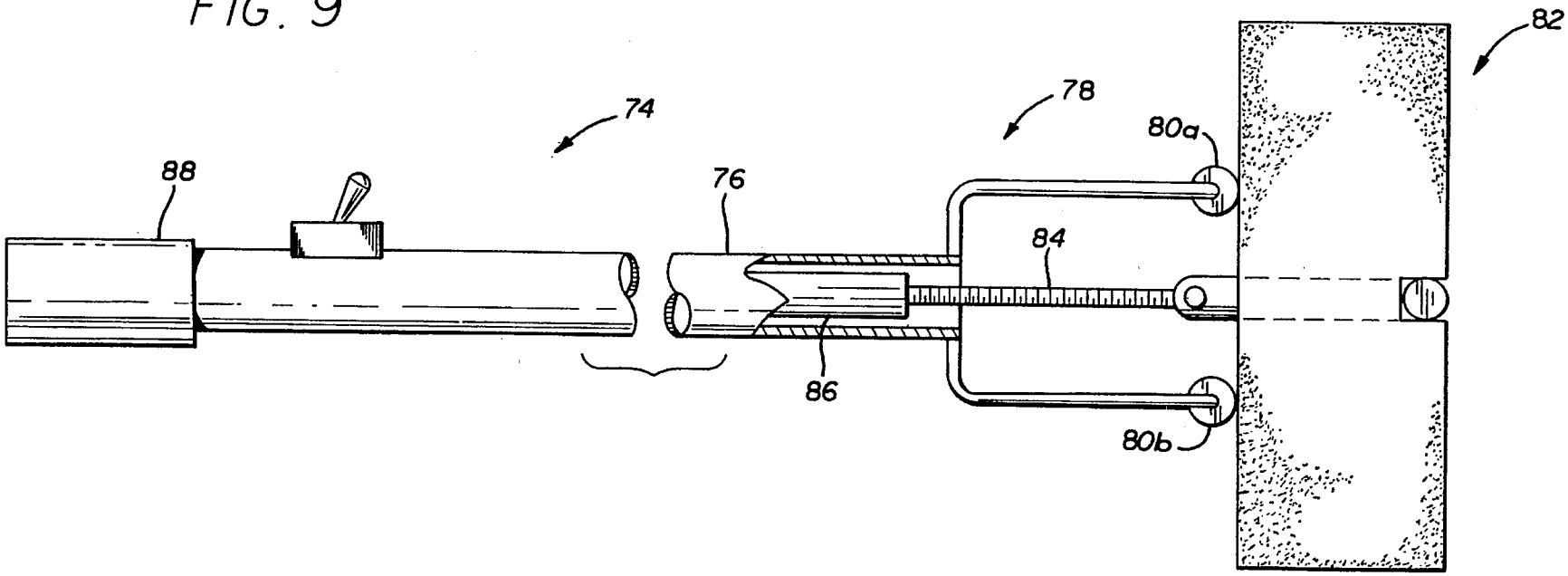
FIG. 9 is a side view of another powered self-wringing mop.

Another example of a powered self-wringing mop is illustrated in FIG. 9. The mop, which is generally indicated by reference numeral 74, includes a handle 76 and a wringer head assembly 78 affixed to one end of the handle. The wringer head assembly includes rollers 80*a* and 80*b*. A cleaning element assembly 82 is operably connected to one end of a screw 84 which extends through handle 76. The other end of the screw is connected to an internally threaded rotating cylindrical member 86. Rotation of the cylindrical member, which is caused by a bi-directional motor 88, causes the screw to move relative to the handle, thereby causing mop head assembly 82 to be moved to and from the wringing position. Thus, the user of the mop does not have to manually provide the force necessary to wring the cleaning element. The motor may be either an AC motor or a DC motor, and if necessary, a power converter may be provided on the mop. The flow of current to the motor is controlled by a switch 90. So is the direction of the motor. Current may be supplied to the motor through an electrical cord or by a battery housed on the mop itself.

It should be noted that a number of other powering devices may be employed in place of the pneumatic piston and cylinder and electric motor/rotating cylinder arrangements described above. Such devices include hydraulic piston and cylinder units, sprocket and pulley arrangements, lead screw and follower arrangements, and other similar devices known to those skilled in the art.

Figure 11:
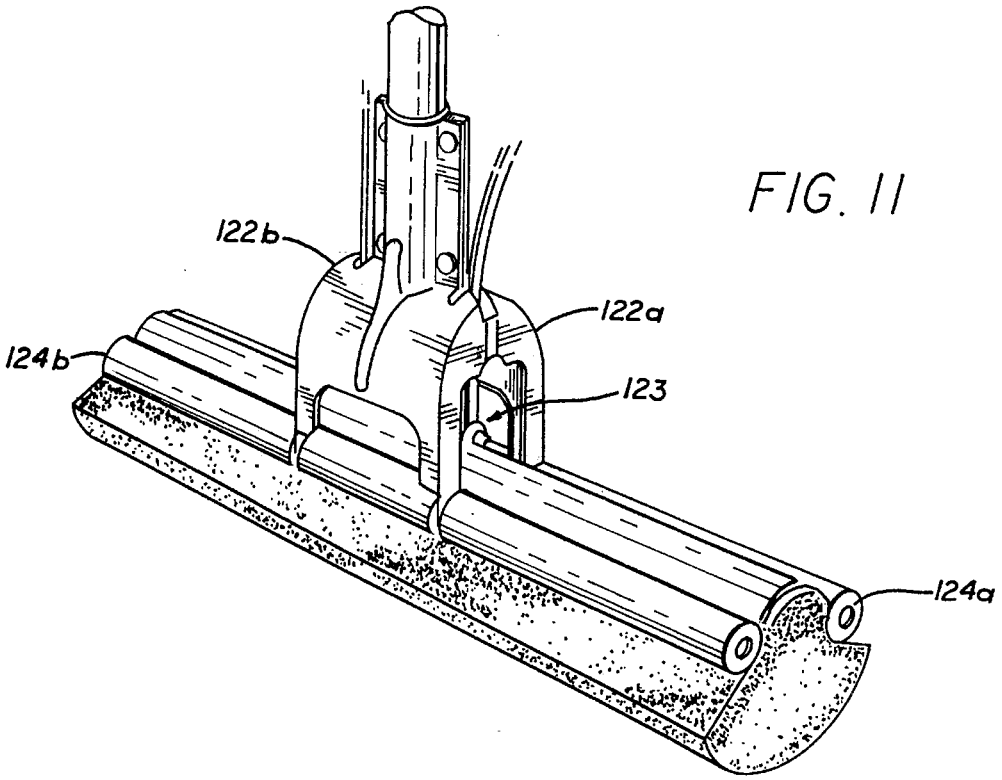
FIG. 11 is a perspective view of a conventional wringer head assembly.

Conventional wringer head assemblies, such as that shown in FIG. 11, include a pair of stamped metal plates 122*a* and 122*b* which support rollers 124*a* and 124*b*. There are a number of problems associated with this design. For example, the stamped metal plates can be easily bent, which in turn causes the rollers to become misaligned. The metal plates also flex excessively during wringing, which reduces the wringing efficiency of the mop head. Stamped plates also tend to be sharp, which can lead to scratched surfaces and injuries. In addition, dirt is often trapped in the corners of the plates and, because conventional head assemblies do not cover the open end of the mop handle, dirt and cleaning solution are also allowed into the handle. Finally, the stamped metal parts are configured such that they interfere with the removal and replacement of the mop assembly. Area 123, which is where the mop's actuator rods connect to the cleaning element assembly, is covered by plates 122*a* and 122*b*.

Turning now to the present wringer head assembly, preferred embodiments of which are illustrated in FIGS. 12–16 and generally indicated by reference numeral 92, the assembly includes a base 94 to which a pair of support rods 96*a* and 96*b* are secured. The base also acts as a cover to close the top end of the handle. (Note FIG. 14.) Roller axis support members 98*a* and 100*a* are secured to opposite ends of rod 96*a*. Similarly, roller axis support members 98*b* and 100*b*

Figure 12:
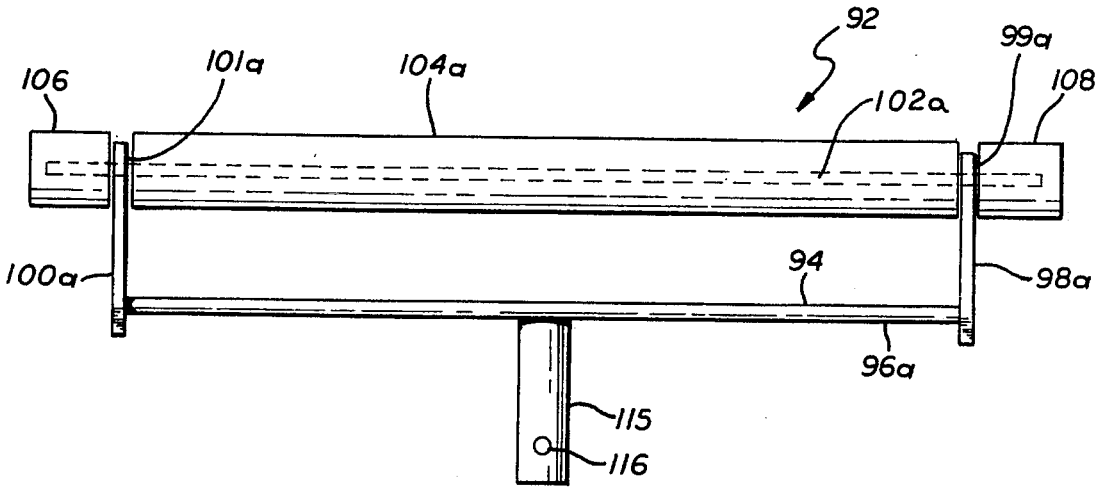
FIG. 12 is a front view of a wringer head assembly in accordance with the present invention.

(100*b* not shown) are secured to opposite ends of rod 96*b*. Two adjacent roller axis support members may, as shown by way of example in FIG. 15, form a single unitary structure. Alternatively, adjacent roller axis support members 98*a*' and 98*b*' may, as shown by way of example in FIG. 16, remain separate. Roller axis 102*a*, which supports a roller 104*a*, is itself supported by support members 98*a* and 100*a*, and its ends extend through apertures 99*a* and 101*a* formed in the support members. Similarly, roller axis 102*b*, which supports a roller 104*b*, is itself supported by support members 98*b* and 100*b*, and its ends extend through apertures 99*b* and 101*b* (not shown) formed in the support members. As shown in FIG. 12, the roller axis support member are located in such a manner that they will not interfere with removal or replacement of a cleaning element assembly.

Support rods 96*a* and 96*b* function as torsion rods to assist in controlling the amount of flexing in the direction indicated by arrows C during wringing processes. The size, shape and composition of the support rods may be selected so as to insure the proper amount of flex for a particular application. For example, in a common household mop, the rods may preferably be 300 series stainless steel or plated/painted spring steel. Additionally, in the embodiment illustrated in FIG. 15, a pair of relief grooves 114*a* and 114*b* may be formed in the unitary configuration for additional flex control. The grooves may be any suitable shape or size. Also, particular material(s) may be used to form the roller axis support members so that further flex control is provided.

A pair of end caps 106 and 108 are mounted on the ends of roller axis 102*a*. Although not shown in the drawings, a similar pair of end caps are mounted on roller axis 102*b*. The end caps may be configured such that their diameter is substantially equal to the diameter of the rollers and may also be formed from the same material as the rollers. Accordingly, the end caps may function as a portion of the rollers. The end caps advantageously prevent the roller axis from scratching the surfaces which the mop comes into contact with.

The bottom portions of roller axis support members 98*a*, 98*b*, 100*a* and 100*b* include an aperture 110*a*, 110*b*, 112*a* and 112*b* (112*a* and 112*b* not shown), respectively, that is adapted to receive an end of one of the support rods. Similar apertures 110*a*' and 110*b*' are shown in FIG. 16. The support rods may be secured within the apertures by welding, soldering or other means known to those of skill in the art. As illustrated for example in FIGS. 12 and 14, a handle attachment member 115 extends from base 94 and has an aperture 116 formed therein. Aperture 116 is located such that it corresponds to an aperture 118 formed in a mop handle 120. The base and handle may, therefore, be secured to one another by inserting a screw, nut and bolt arrangement or quick-release locking pin into the aligned apertures. Such an arrangement allows the wringer head assembly or the handle to be relatively easily replaced. A seal, such as an O-ring seal, may be placed between handle 120 and base 94 when the wringer head assembly is secured to the handle to inhibit the flow of water or solvents between the handle and base.

An alternative wringer head assembly, generally indicated by reference numeral 126, is illustrated in FIG. 17. The assembly is primarily composed of a one-piece stainless steel plate 128 that is bent into the orientation shown. The bent portions include roller axis support members 130*a*, 130*b*, 132*a* and 132*b* and stiffening dimples 134*a–d*. The plate 128 includes a pair of holes 136*a* and 136*b* which reduce the weight of the assembly and a pair of holes 138*a* and 138*b* which the mop's actuation rods to connect to the cleaning element assembly. A handle attachment member 140, which includes a fastening hole 142, is secured to the plate 128, preferably by welding.

A number of other features may be incorporated into the present wringer head assembly. The metal parts may be electropolished and Teflon™ sleeves may be provided where a moving metal part is in contact with another metal part. In addition, a variety of rollers may be used. For example, the rollers may be textured, grooved, hard, soft, solid or perforated. Moreover, for those applications where a single use bouffant-type disposable cover is being used to cover the mop head, the wringer assembly may be adapted to include cutting devices, such as blades or hooks. The cutting devices engage the elastic band used to hold the cover on the mop head when wringer head assembly is actuated. Thus, the cover may be removed from the mop head and discarded after use without being touched by the user.

Although the present invention has been described in terms of the preferred embodiment above, numerous modifications and/or additions to the above-described preferred embodiments would be readily apparent to one skilled in the art. It is intended that the scope of the present invention extends to all such modifications and/or additions and that the scope of the present invention is limited solely by the claims set forth below.

I claim:

1. A reversible cleaning element for use with a mop, comprising:

a liquid absorbent main body defining a length, an overall width, a thickness, a top surface, a bottom surface and a pair of side surfaces;

a first channel associated with the top surface of the main body, the first channel defining a length, a width and a depth, the depth of the first channel being substantially less than one half of the overall thickness of the main body;

a second channel associated with the bottom surface of the main body, the second channel defining a length, a width and a depth, the depth of the second channel being substantially less than one half of the overall thickness of the main body; and at least one aperture associated with the main body and channels and passing completely through the main body from the top surface to the bottom surface, the at least one aperture defining a width substantially equal to the width of the channels.

2. A cleaning element as claimed in claim 1, wherein the at least one aperture comprises a pair of longitudinally spaced apertures.

3. A cleaning element as claimed in claim 1, wherein the channels extend longitudinally between the side surfaces.

4. A cleaning element as claimed in claim 1, wherein at least one of the top and bottom surfaces includes a generally curved portion.

5. A cleaning element as claimed in claim 1, wherein at least one of the side surfaces includes a generally curved portion.

6. A cleaning element as claimed in claim 1, wherein at least one of the side surfaces includes a pair of generally planar surfaces defining an angle therebetween.

7. A cleaning element as claimed in claim 1, further comprising:

a cover member covering at least one of the top surface, the bottom surface and the side surfaces.

8. A cleaning element as claimed in claim 7, wherein the cover member covers the top surface, the bottom surface and the side surfaces.

9. A cleaning element assembly for use with a mop, the mop including at least one cleaning element assembly attachment member which is resilient and capable of being flexed between a holding position and a release position, the cleaning element assembly comprising:

a reversible liquid absorbent cleaning element including a main body defining a length, a width, a thickness, a top surface, a bottom surface, a pair of side surfaces, at least one aperture associated with the main body defining a width and passing completely through the main body from the top surface to the bottom surface, a first channel associated with the top surface of the main body, the first channel defining a length, a width substantially equal to the width of the aperture and a depth, the depth of the first channel being substantially less than one half of the overall thickness of the main body, and a second channel associated with the bottom surface of the main body, the second channel defining a length, a width substantially equal to the width of the aperture and a depth, the depth of the second channel being substantially less than one half of the overall thickness of the main body; and a bracket including a holding member and at least one bracket attachment member extending through the at least one aperture, the at least one bracket attachment member including an aperture adapted to be engaged by the at least one resilient cleaning element assembly attachment member when the cleaning element assembly attachment member is in the holding position.

10. A cleaning element assembly as claimed in claim 9, wherein the at least one aperture associated with the main body of the cleaning element comprises a pair of longitudinally spaced apertures and the at least one bracket attachment comprises a pair of longitudinally spaced bracket attachment members.

11. A cleaning element assembly for use with a mop, the mop including at least one cleaning element assembly attachment member which is resilient and capable of being flexed between a holding position and a release position, the cleaning element assembly comprising:

a reversible cleaning element including a main body composed of an liquid absorbent material and defining a length, a width, a thickness, a first cleaning surface, a second cleaning surface and at least one aperture associated with the main body defining a width and passing completely through the main body from the first cleaning surface to the second cleaning surface, a first channel associated with the first cleaning surface of the main body, the first channel defining a length, a width substantially equal to the width of the aperture and a depth, the depth of the first channel being substantially less than one half of the overall thickness of the main body, and a second channel associated with the second cleaning surface of the main body, the second channel defining a length, a width substantially equal to the width of the aperture and a depth, the depth of the second channel being substantially less than one half of the overall thickness of the main body; and a bracket including a holding member and an attachment device including an aperture adapted to be engaged by the at least one resilient cleaning element assembly attachment member when the cleaning element assembly attachment member is in the holding position in such a manner that the holding member is associated with the cleaning surface of the cleaning element and at least one of the attachment device and the at least one resilient cleaning element assembly attachment member extends through the at least one aperture.

12. A cleaning element assembly as claimed in claim 11, wherein the at least one aperture comprises a pair of longitudinally spaced apertures.

13. A cleaning element assembly as claimed in claim 11, wherein the attachment device comprises a bracket attachment member adapted to extend through the at least one aperture associated with the main body of the cleaning element.

14. A reversible cleaning element for use with a mop, comprising:

a liquid absorbent main body defining a length, a width, a thickness, a top surface, a bottom surface and a pair of side surfaces;

a first channel associated with the top surface of the main body, the first channel defining a length, a width and a depth, the depth of the first channel being substantially less than one half of the overall thickness of the main body;

a second channel associated with the bottom surface of the main body, the second channel defining a length, a width and a depth, the depth of the second channel being substantially less than one half of the overall thickness of the main body; and at least two apertures associated with the main body and channels and passing completely through the main body from the top surface to the bottom surface, the at least two apertures defining a length extending substantially perpendicularly to the channel and a width, the width of each of the at least two apertures being substantially equal to the width of the channels.

15. A cleaning element as claimed in claim 14, wherein the channels extend longitudinally between the side surfaces.

16. A cleaning element as claimed in claim 14 wherein the width of the channel associated with the top surface of the main body is approximately the same as the the depth of the channel associated with the top surface of the main body portion.

17. A cleaning element as claimed in claim 16 wherein the top and bottom surfaces of the main body are substantially symmetrical with respect to each other.

18. A cleaning element as claimed in claim 17 wherein the side surfaces of the main body are substantially symmetrical with respect to each other.

* * * * *